US006853139B2

(12) United States Patent
Yamashita et al.

(10) Patent No.: US 6,853,139 B2
(45) Date of Patent: Feb. 8, 2005

(54) COLD-CATHODE DISCHARGE LAMP AND LAMP DEVICE HAVING REDUCED SPUTTERING ON INTERNAL LEAD-IN WIRE

(75) Inventors: Hirofumi Yamashita, Moriguchi (JP); Haruo Yamazaki, Moriyama (JP); Toshihiro Terada, Amagasaki (JP); Shinji Kihara, Maiduru (JP)

(73) Assignee: Matsushita Electric Industrial Co., Ltd. (JP)

( * ) Notice: Subject to any disclaimer, the term of this patent is extended or adjusted under 35 U.S.C. 154(b) by 104 days.

(21) Appl. No.: 10/106,206

(22) Filed: Mar. 27, 2002

(65) Prior Publication Data

US 2002/0140351 A1 Oct. 3, 2002

(30) Foreign Application Priority Data

Mar. 28, 2001 (JP) ..... 2001-091525

(51) Int. Cl.[7] ..... H01J 17/18
(52) U.S. Cl. ..... 313/623; 313/491
(58) Field of Search ..... 313/623, 633, 313/634, 341, 345, 355, 352, 491, 346 R, 346 DC, 630, 574, 309

(56) References Cited

U.S. PATENT DOCUMENTS 5,962,977 A * 10/1999 Matsumoto et al. ..... 313/633
6,281,626 B1 * 8/2001 Nakamura et al. ..... 313/491

FOREIGN PATENT DOCUMENTS

| | | |
|---|---|---|
| JP | 54-28322 | 3/1979 |
| JP | 04137429 A | 5/1992 |
| JP | 04274156 A | 9/1992 |
| JP | 04337239 A | 11/1992 |
| JP | 04337240 A | 11/1992 |
| JP | 08321279 A | 12/1996 |
| JP | 2001176445 A | 6/2001 |

* cited by examiner

*Primary Examiner*—Joseph Williams
(74) *Attorney, Agent, or Firm*—Parkhurst & Wendel, L.L.P.

(57) ABSTRACT

The present invention has an object to provide a cold-cathode discharge lamp which can suppress sputtering on a lead-in wire and reduce consumption of mercury so as to achieve a longer lifetime without increasing an amount of applied mercury. The cold-cathode discharge lamp of the present invention is characterized in that a lead-in wire connected to a cylindrical electrode in a lighting tube is made of a material same as a material that forms the cylindrical electrode. It is possible to suppress concentration negative glow discharge shifted to the lead-in wire and to allow the electrode to be covered with even negative glow discharge. Thus, it is possible to reduce mercury consumed by excessive sputtering on the outer surface of the internal lead-in wire and to achieve a longer lifetime of the cold-cathode discharge lamp.

8 Claims, 5 Drawing Sheets

COLD-CATHODE DISCHARGE LAMP AND LAMP DEVICE HAVING REDUCED SPUTTERING ON INTERNAL LEAD-IN WIRE

FIELD OF THE INVENTION

The present invention relates to a cold-cathode discharge lamp used for backlighting of a liquid crystal display and the like.

BACKGROUND OF THE INVENTION

A cold-cathode discharge lamp used as a light source for backlighting of a liquid crystal display is configured such that cylindrical or plate metal is provided as an electrode in a lighting tube, which has a phosphor applied onto the inner surface of a glass tube, mercury and the like is contained therein, and the phosphor is excited by ultraviolet radiation that is generated in the lighting tube by discharge to provide visible radiation.

As to such a cold-cathode discharge lamp, a variety of studies on miniaturization, a smaller diameter, higher luminance, and a longer lifetime have been conducted in response to diversity of liquid crystal displays. For example, Japanese Patent Laid-Open No. 4-137429 proposes a cold-cathode discharge lamp, in which in order to reduce mercury consumed by sputtering in a lamp, a cylindrical electrode has an inner surface formed by a conductor and an outer surface formed by an insulator such that negative glow discharge does not circulate the outer circumferential surface of the cylindrical electrode.

In the cold-cathode discharge lamp configured thus, although it is possible to suppress blackening and consumption of mercury that are caused by sputtering materials on a tube inner wall, in the case of a large-current region demanding high luminance, negative glow discharge moves beyond the outside surface of the cylindrical electrode, which is formed by an insulator, to an internal lead-in wire. In such a state, the lead-in wire, which is drawn into a lighting tube to connect the cylindrical electrode and an external power supply and to hermetically seal the lighting tube, is less resistant to sputtering as compared with the cylindrical electrode. Thus, more sputtering materials are generated by increased sputtering on the lead-in wire, and mercury is consumed in the lamp, thereby interfering with a longer lifetime for the cold-cathode discharge lamp.

The present invention has as its object the provision of a cold-cathode discharge lamp which can solve the above-mentioned problem. The cold-cathode discharge lamp can suppress sputtering on a lead-in wire to achieve a longer lifetime.

DISCLOSURE OF THE INVENTION

A cold-cathode discharge lamp is characterized in that an electrode is covered with even discharge.

According to the present invention, it is possible to suppress sputtering on a lead-in wire to achieve a longer lifetime of the cold-cathode discharge lamp.

A cold-cathode discharge lamp according to aspect 1 of the present invention, comprising a lighting tube having a phosphor applied onto its inner surface, and a lead-in wire connected to an external power supply and provided at an end of the lighting tube, an end of the lead-in wire is connected to a cylindrical electrode, and the phosphor is excited by ultraviolet radiation to provide visible radiation, the ultraviolet radiation being generated by discharge in the lighting tube, is characterized in that at least a part of the lead-in wire in the lighting tube is made of the same material as the cylindrical electrode.

A cold-cathode discharge lamp according to aspect 2 of the present invention, comprising a lighting tube having a phosphor applied onto its inner surface, and a lead-in wire connected to an external power supply and provided at an end of the lighting tube, wherein an end of the lead-in wire is connected to a cylindrical electrode, and the phosphor is excited by ultraviolet radiation to provide visible radiation, the ultraviolet radiation being generated by discharge in the lighting tube, is characterized in that an outer surface of the lead-in wire in the lighting tube is covered with the same material as a material that forms the cylindrical electrode.

A cold-cathode discharge lamp according to aspect 3 of the present invention, comprising a lighting tube having a phosphor applied onto its inner surface, and a lead-in wire connected to an external power supply and provided at an end of the lighting tube, wherein an end of the lead-in wire is connected to a cylindrical electrode, and the phosphor is excited by ultraviolet radiation to provide visible radiation, the ultraviolet radiation being generated by discharge in the lighting tube, is characterized in that at least a part of the surface of the lead-in wire in the lighting tube is made of a material having a larger work function value than that of a material that forms the inner surface of the cylindrical electrode.

A cold-cathode discharge lamp according to aspect 4 of the present invention, comprising a lighting tube having a phosphor applied onto its inner surface, and a lead-in wire connected to an external power supply and provided at an end of the lighting tube, wherein an end of the lead-in wire is connected to a cylindrical electrode, and the phosphor is excited by ultraviolet radiation to provide visible radiation, the ultraviolet radiation being generated by discharge in the lighting tube, is characterized in that at least a part of the surface of the lead-in wire in the lighting tube is covered with an insulating coating.

DESCRIPTION OF THE EMBODIMENTS

Referring to FIGS. 1 to 5, embodiments of the present invention will be discussed below.

Embodiment 1

Figure 1:
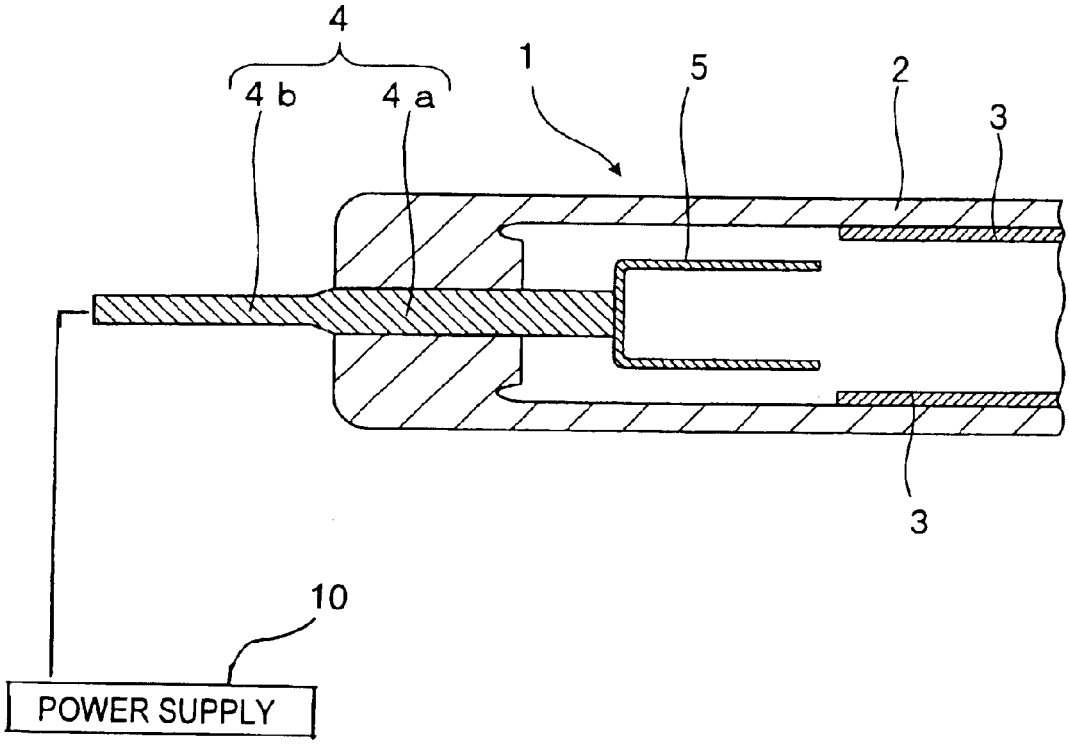
FIG. 1 is a sectional view of a main part of a cold-cathode discharge lamp according to (Embodiment 1) of the present embodiment.
Figure 2:
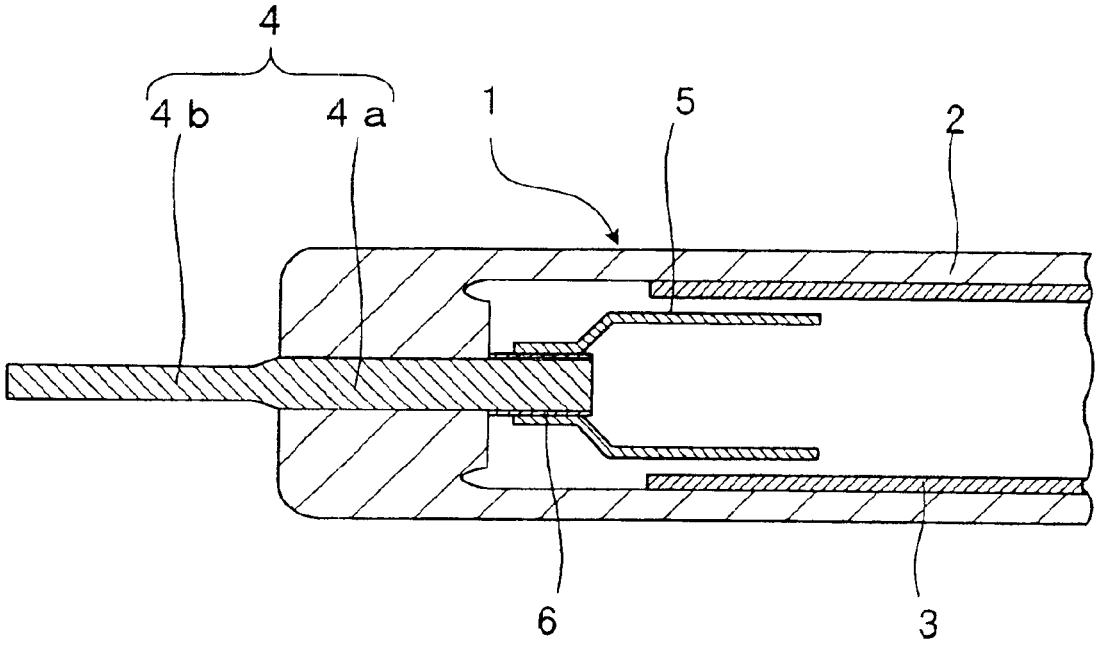
FIG. 2 is a sectional view showing an example other than the cold-cathode discharge lamp shown in FIG. 1 according to (Embodiment 1) of the present invention.

FIGS. 1 and 2 show (Embodiment 1) of the present invention.

As shown in FIG. 1, a lead-in wire 4 is provided at an end of a lighting tube 1 having a phosphor 3 applied onto the inner surface of a glass tube 2. The lead-in wire 4 has one end connected to an external power supply 10 and the other end connected to a conductive cylindrical electrode 5. A suitable amount of mercury and rare gas is contained into the lighting tube 1, and sealing is performed on the lighting tube 1.

The lead-in wire 4 is constituted by an internal lead-in wire 4*a,* which is connected in the lighting tube 1 to the non-discharge end of the cylindrical electrode 5 and hermetically seals the lighting tube 1, and an outer lead-in wire 4*b* connected to the external power supply via the internal lead-in wire 4*a* outside the lighting tube 1.

When current is supplied to the cylindrical electrode 5 from the external power supply via the lead-in wire 4, discharge occurs in the lighting tube 1, and ultraviolet radiation generated by the discharge excites the phosphor 3 so as to obtain visual radiation.

As to the cold-cathode discharge lamp configured thus, in the present embodiment, at least the outer surface of the internal lead-in wire 4*a* is made of the same material as the cylindrical electrode 5 in order to reduce sputtering on the internal lead-in wire 4*a*.

Hereinafter, explanation will be made according to specific examples.

In the cold-cathode discharge lamp configured as FIG. 1, the glass tube 2 is made of a hard glass material such as Kovar glass, and on the inner surface of the glass tube 2, a three-band type phosphor is applied with a thickness of about 20 $\mu$m as the phosphor 3. The lighting tube 1 contains mercury and rare gas (not shown).

As the internal lead-in wire 4*a,* a material is selected which is approximate in expansion coefficient to a hard glass material that forms the glass tube 2 and has conductivity because it is necessary to hermetically seal the end of the glass tube 2. As such a metallic material, a metallic material including an alloy of Fe, Ni, and Co is applicable.

Further, the cylindrical electrode 5 is made of the same material as the metallic material that forms the internal lead-in wire 4*a* that includes an alloy of Fe, Ni, and Co.

The end of the internal lead-in wire 4*a* is connected to the cylindrical electrode 5 by welding such as laser welding, and the other end of the internal lead-in wire is connected to the outer lead-in wire 4*b* by welding.

In this manner, with the cold-cathode discharge lamp in which the internal lead-in wire 4*a* and the cylindrical electrode 5 are made of the same material, it is possible to suppress the concentration of negative glow discharge shifted to the internal lead-in wire 4*a,* and the electrode is covered with even negative glow discharge. Thus, it is possible to reduce consumption of mercury that is caused by allowing the outer surface of the internal lead-in wire 4*a* to be subjected to excessive sputtering, thereby achieving a longer life time of the cold-cathode discharge lamp.

Moreover, as shown in FIG. 2, only the outer surface of the internal lead-in wire 4*a,* which is subjected to sputtering, may be covered with a film 6 made of the same material as the cylindrical electrode 5.

For example, as to the cold-cathode discharge lamp configured as FIG. 1, when the glass tube 2 is made of borosilicate glass, the internal lead-in wire 4*a* is made of tungsten, and the cylindrical electrode 5 is made of nickel, an exposed part of the internal lead-in wire 4*a* in the lighting tube 1 is subjected to nickel plating using the same material as the cylindrical electrode 5 so as to form the film 6.

The above-mentioned configuration can similarly suppress concentration of negative glow discharge shifted to the internal lead-in wire 4*a* and reduce consumption of mercury.

Besides, the present embodiment discussed an example in which the internal lead-in wire 4*a* is made of tungsten, and the cylindrical electrode 5 is made of nickel having a larger work function value than that of tungsten. The present invention is not limited to the above configuration. For example, the following configuration is also applicable: the internal lead-in wire 4*a* is made of tungsten, and the cylindrical electrode 5 is made of a variety of metallic materials including aluminum and molybdenum and the like.

Conventionally, since the combination has been limited regarding a glass material that forms the glass tube 2 and the internal lead-in wire 4*a,* just a few kinds of the internal lead-in wire 4*a* has been applicable. In contrast, the present invention has a wider range of selection for applicable internal lead-in wires 4*a*. Further, as compared with the case where the internal lead-in wire 4*a* and the cylindrical electrode 5 are made of the same material as shown in FIG. 1, a material of the cylindrical electrode 5 can be selected without depending upon a material of the internal lead-in wire 4*a*.

Embodiment 2

Figure 3:
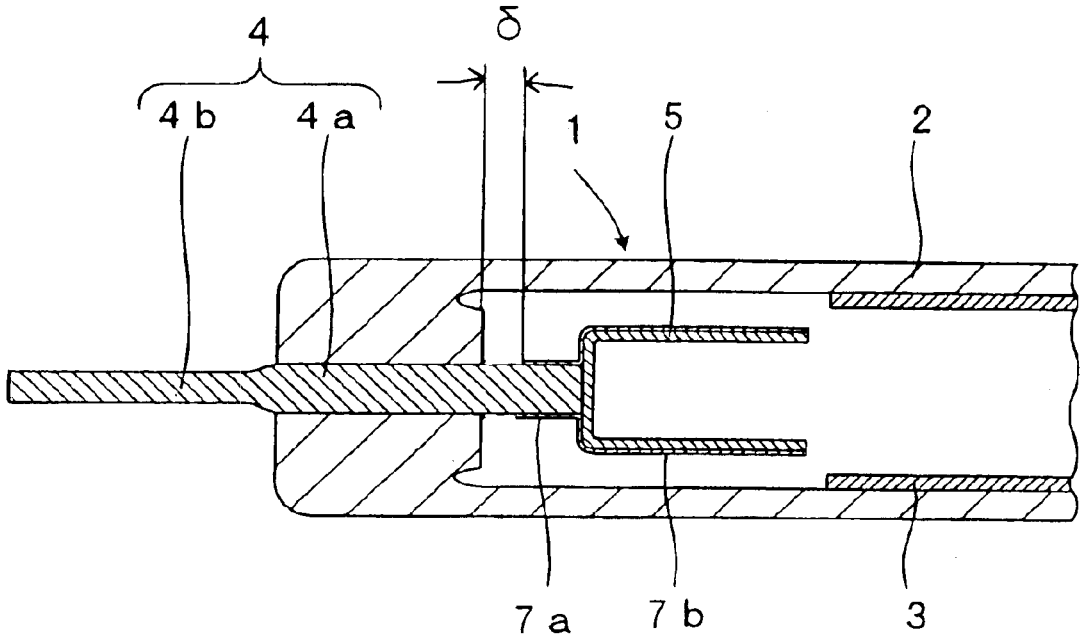
FIG. 3 is a sectional view of a cold-cathode discharge lamp according to (Embodiment 2) of the present invention.

FIG. 3 shows (Embodiment 2) of the present invention.

(Embodiment 2) is different from (Embodiment 1) in that at least a part of the surface of an internal lead-in wire 4*a* is made of a material having a larger work function value than that of a material that forms the inner surface of a cylindrical electrode 5.

Hereinafter, explanation will be made according to specific examples.

As shown in FIG. 3, in a cold-cathode discharge lamp configured as FIG. 1, a glass tube 2 is made of a hard glass material such as borosilicate glass, and the internal lead-in wire 4*a* is made of a material such as tungsten, which is approximate in expansion coefficient to the hard glass material that forms the glass tube 2.

A material of the cylindrical electrode 5 is not particularly limited. For example, the cylindrical electrode 5 is made of tungsten, which is the same material as the internal lead-wire 4*a,* nickel having a larger work function value than that of the material that forms the internal lead-in wire 4*a,* and niobium having a small work function value.

Moreover, an exposed part of the internal lead-in wire 4*a* in the lighting tube 1 and the outer surface of the cylindrical electrode 5 are covered with films 7*a* and 7*b*. The films 7*a* and 7*b* are made of a material having a larger work function value than that of a material that forms the internal lead-in wire 4*a* and a material that forms the cylindrical electrode 5. For example, when the internal lead-in wire 4*a* is made of tungsten and the cylindrical electrode 5 is made of niobium, a material such as silver is used and evaporation is performed when the films 7*a* and 7*b* are formed. Reference character "δ" identifies a portion of such example arrangement internal wire 4*a* not covered by film 7*a*, 7*b* in FIG. 3.

In the cold-cathode discharge lamp configured thus, the internal lead-in wire 4*a* and the outer circumferential surface of the cylindrical electrode 5 are attached to each other using a material which has a larger work function value than that of materials that form the internal lead-in wire 4*a* and the cylindrical electrode 5. Hence, negative glow discharge develops mainly on the inner surface of the cylindrical electrode 5 having a small work function value.

With this configuration as well, it is possible to suppress consumption of mercury that is caused by excessive sputtering so as to achieve a longer lifetime of the cold-cathode discharge lamp.

Here, the above explanation discussed an example of the films 7*a* and 7*b* using silver evaporation. The present invention is not limited to the above example. Any material can be used for the films 7*a* and 7*b* as long as the material has a larger work function value than that of the materials of the internal lead-in wire 4*a* and the cylindrical electrode 5. A material such as Cr and Cu is also applicable.

Furthermore, the above explanation discussed an example in which the films 7*a* and 7*b* are made of the same material. The same effect can be obtained when the film 7*b* is made of a material having a smaller work function value than that of the film 7*b* or when the film 7*b* is not formed.

Embodiment 3

Figure 4:
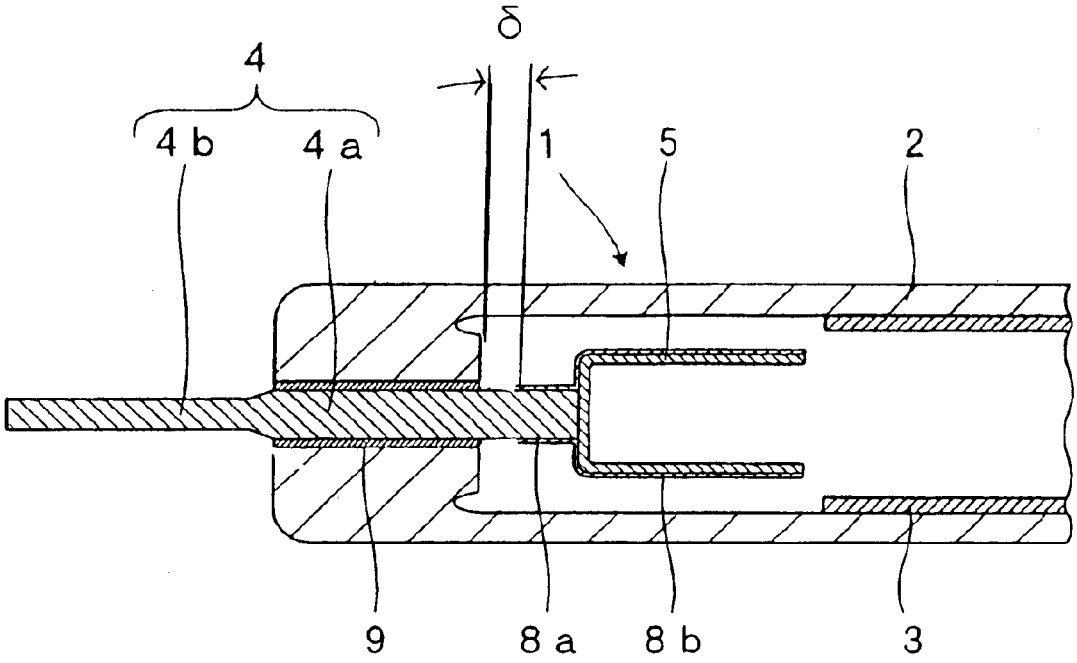
FIG. 4 is a sectional view of a cold-cathode discharge lamp according to (Embodiment 3) of the present invention.

FIG. 4 shows (Embodiment 3) of the present invention.

As to a cold-cathode discharge lamp configured as FIG. 3, (Embodiment 3) is different from (Embodiment 2) in that at least a part of the surface of an internal lead-in wire 4*a* is covered with insulating coatings 8*a* and 8*b*, instead of covering the outer surface of the internal lead-in wire 4*a* and the outer surface of the cylindrical electrode 5 with a material having a large work function value. Reference character "δ" identifies a portion of such example arrangement internal wire 4*a* not covered by film 8*a*,8*b* in FIG. 4.

To be specific, an oxide film 9 is formed on a part of the internal lead-in wire 4*a* that abuts a glass tube 2 on the internal lead-in wire 4*a*. The internal lead-in wire 4*a* is made of stainless (e.g., stainless containing 6% of chromium referred to as a 426 alloy, 42 to 47% of nickel, and iron accounting for the remainder). On the outer circumferential surface of the internal lead-in wire 4*a* in the lighting tube 1, an insulating film 8*a* is made of a material for maintaining hermeticity by using an alloy layer of the oxide film 9 and the glass tube 2. For example, the insulating film 8*a* is made of an insulating material composed of a material that forms an oxide film of a stainless 426 alloy.

Moreover, for example, the outer surface of the cylindrical electrode 5 made of Fe and so on is insulated by the insulating film 8*b* including an oxide film.

In the cold-cathode discharge lamp configured thus, the internal lead-in wire 4*a* and the outer circumferential surface of the cylindrical electrode 5 are insulated by an insulating material, an oxide film, and soon. Thus, negative glow discharge develops only on the inner surface of the cylindrical electrode 5 having conductivity, so that it is possible to reduce consumption of mercury that is caused by excessive sputtering on the outer surface of the cylindrical electrode 5 and the internal lead-in wire 4*a*.

Besides, the insulating films 8*a* and 8*b* for covering the internal lead-in wire 4*a* and the cylindrical electrode 5 are not particularly limited as long as an insulating effect is obtained. The same effect can be obtained by insulation made by applying ceramics and the like.

The following will discuss specific examples of the above described embodiments.

EXPERIMENTAL EXAMPLE 1

A cold-cathode discharge lamp of FIG. 1 was formed according to the following steps.

On the inner surface of a glass tube 2 which was made of Kovar glass and was 2.4 mm in outer diameter, 2.0 mm in inside diameter, and 300 mm in length, and a three-band type phosphor 3 having color temperature of 5000 K was applied with a thickness of about 20 μm so as to form a lighting tube 1. A bottomed cylindrical electrode 5 was provided at an end of the lighting tube 1. The cylindrical electrode 5 was composed of an alloy of Fe, Ni, and Co and was 1.2 mm in outer diameter, 1.0 mm in inside diameter, and 5 mm in length.

An internal lead-in wire 4*a* was connected to the non-discharge end of the cylindrical electrode 5 by resistance welding. The internal lead-in wire 4*a* was made of the same material as the alloy of Fe, Ni, and Co for forming the cylindrical electrode 5 and was 0.8 mm in outer diameter.

And then, mercury of about 1500 μg, which was three times a conventional amount of about 500 μg, was applied into the lighting tube 1, and argon-neon mixed gas of 8 kPa was applied therein as buffer gas so as to form a cold-cathode discharge lamp, which was used as a trial lamp B.

Further, for comparison with the trial lamp B, a trial lamp A was formed.

The trial lamp A was formed in the same manner as the trial lamp B except that a cylindrical electrode 5 is made of nickel having a larger work function value than that of an alloy of Fe, Ni, and Co, and the cylindrical electrode 5 has a hollow electrode structure in which an alumina layer was applied as an insulating film having a thickness of 3 μm on the outer circumferential surface of the cylindrical electrode 5.

Figure 5:
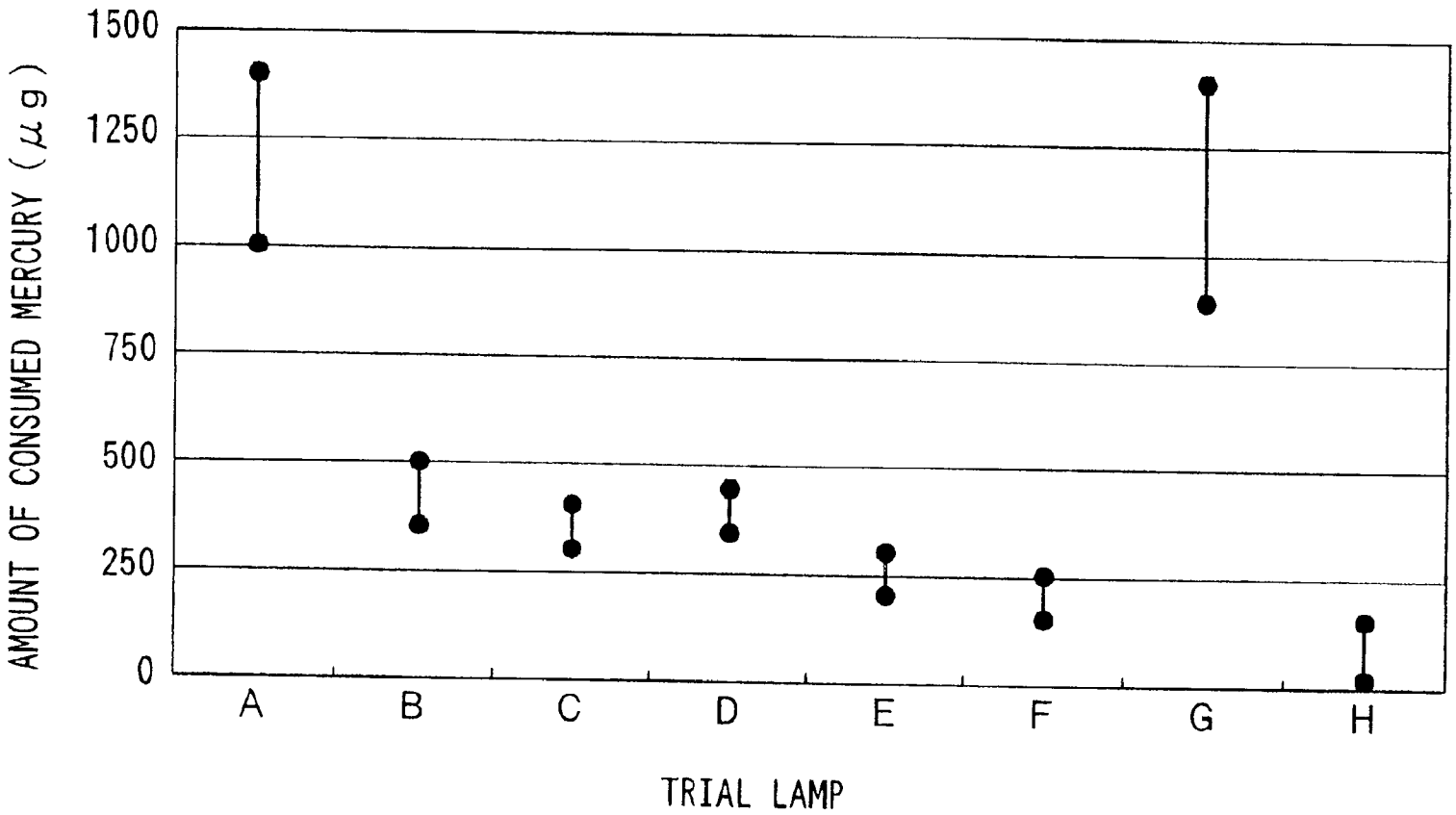
FIG. 5 is a graph showing measurement results of lighting experiments in each experimental examples of the present invention.

With the trial lamps A and B, at a low ambient temperature of 0° C. where mercury consumed by sputtering was increased, a high-frequency sine wave lighting circuit was used to conduct a lighting experiment at a lamp current of 8 mA. In this case, the measurement results of FIG. 5 were obtained. Here, FIG. 5 shows an average value of mercury consumption when ten trial lamps of each type were used for lighting time period of 1000 hours.

As is evident from that blackening due to sputtering on the inner wall of the glass tube 2 intensively spread around the internal lead-in wire 4*a*, the trial lamp A for comparison resulted in concentration of negative glow discharge around the internal lead-in wire 4*a* having a small work function value. Thus, consumption of mercury was increased to 1000 to 1400 μg.

Meanwhile, as is evident from that blackening due to sputtering on the innerwall of the glass tube 2 lightly spread over the electrode, in the trial lamp B where the internal lead-in wire 4*a* and the cylindrical electrode 5 were made of the same material, negative glow discharge became even so as to cover the cylindrical electrode 5 and the internal lead-in wire 4*a*, thereby suppressing concentration of negative glow discharge shifted to the internal lead-in wire 4*a*. Consequently, it was possible to reduce consumption of mercury to about one third of that of the trial lamp A, thereby improving the lifetime of the cold-cathode discharge lamp without increasing an amount of applied mercury.

EXPERIMENTAL EXAMPLE 2

Based on the experiment results of (Experimental Example 1), a cold-cathode discharge lamp configured as FIG. 2 was formed as (Experimental Example 2).

Here, a glass tube 2 made of borosilicate glass was used, and a cylindrical electrode 5 was made of nickel. The internal lead-in wire 4*a* was made of tungsten, and nickel plating was performed thereon to form a film 6 with a thickness of about 5 μm. Subsequently, a trial lamp C was formed in the same manner as the trial lamp A except for the above configuration.

Further, a trial lamp D was formed, in which a cylindrical electrode 5 of the trial lamp C was made of aluminum and the outer circumferential surface of the internal lead-in wire 4*a* was subjected to aluminum plating so as to form a film 6 with a thickness of about 5 μm.

The trial lamps C and D were used to conduct a lighting experiment in the same manner as (Experimental Example 1). The obtained measurement results are shown in FIG. 5.

Regarding both of the trial lamps C and D, it was confirmed that blackening due to sputtering on the inner wall of the bulb lightly spread over the electrode, and negative glow discharge spread over the inner and outer surfaces of the cylindrical electrode 5 and the internal lead-in wire 4*a* so as to suppress concentration of negative glow discharge shifted to the internal lead-in wire. Further, as shown in FIG. 5, the trial lamp C could reduce consumption of mercury to 300 to 400 μg and the trial lamp D could reduce consumption of mercury to 350 to 450 μg. Like the trial lamp B, the lifetime of the cold-cathode discharge lamp was improved without increasing an amount of applied mercury. Although the trial lamps C and D were somewhat different in consumption of mercury because they use different materials, the same effect was fundamentally obtained. Additionally, in view of the configuration of the electrode, it was possible to widen a range of selection for a material of the cylindrical electrode as compared with the trial lamp B, thereby achieving wide applicability.

EXPERIMENTAL EXAMPLE 3

(Experimental Example 3) was carried out based on (Experimental Example 2).

In a cold-cathode discharge lamp configured as FIG. 3, a glass tube 2 made of borosilicate glass was used and an internal lead-in wire 4*a* was made of tungsten. A cylindrical electrode 5 was made of nickel having a larger work function value than that of the internal lead-in wire 4*a*. And then, on the outer circumferential surface of the internal lead-in wire 4*a* and the outer circumferential surface of the cylindrical electrode 5, silver was subjected to sputter deposition to form the films 7*a* and 7*b* with a thickness of 2 μm. Silver has a larger work function value than that of tungsten for forming the internal lead-in wire 4*a* and nickel for forming the cylindrical electrode 5. A trial lamp E was formed in the same manner as the trial lamp C except for the above configuration.

Further, a trial lamp F was formed in the same manner as the trial lamp E except that niobium having a smaller work function value than that of the internal lead-in wire 4*a* was used as a material of the cylindrical electrode 5.

Also, for comparison with the trial lamps E and F, a trial lamp G was formed. The trial lamp G was configured such that aluminum having a small work function value was used as a sputter deposition material in the trial lamp E to form the films 7*a* and 7*b*.

The trial lamps E to G were used to conduct a lighting experiment in the same manner as (Experimental Example 1). The obtained measurement results are shown in FIG. 5.

Regarding both of the trial lamps E and F, it was confirmed that blackening due to sputtering on the inner wall of the bulb concentrated on the end of the electrode, negative glow discharge concentrated on the inner surface of the cylindrical electrode 5 and hardly spread to the internal lead-in wire 4*a,* and concentration of negative glow discharge shifted to the internal lead-in wire was suppressed. Therefore, the trial lamp E could reduce consumption of mercury to 200 to 300 μg, and the trial lamp F could reduce consumption of mercury to 150 to 250 μg. The above reductions were larger than those of the trial lamps B, C, and D.

Meanwhile, as to the trial lamp G, as is evident from that blackening due to sputtering on the inner wall of the bulb intensively spread to the cylindrical electrode and the internal lead-in wire, negative glow discharge did not concentrate on the inner surface of the cylindrical electrode 5 but entirely on the outer circumferential surface of the cylindrical electrode 5 and the internal lead-in wire 4*a,* thereby increasing consumption of mercury to 900 to 1400 μg.

In this manner, the outer circumferential surface of the internal lead-in wire 4*a* and the outer circumferential surface of the cylindrical electrode 5 were attached to each other using a material having a larger work function value than that of the materials of the internal lead-in wire 4*a* and the cylindrical electrode 5. Hence, negative glow discharge develops mainly on the inner surface of the cylindrical electrode 5 which is made of a material having a small work function value, and consumption of mercury due to excessive sputtering was suppressed on the outer surface of the cylindrical electrode 5 and the internal lead-in wire 4*a,* thereby improving the effect of increasing the lifetime of the cold-cathode discharge lamp without increasing an amount of applied mercury.

EXPERIMENTAL EXAMPLE 4

(Experimental Example 4) was conducted based on the results of (Experimental Example 1) to (Experimental Example 3).

In a cold-cathode discharge lamp of FIG. 4, a glass tube 2 made of borosilicate glass was used and an internal lead-in wire 4*a* was made of tungsten. On a contact part of the internal lead-in wire 4*a* and the glass tube 2, an oxide film 9 was made of a stainless 426 alloy, which can maintain hermeticity by forming an alloy layer of glass and an oxide film. The cylindrical electrode 5 was made of iron. And then, the cylindrical electrode 5 and the internal lead-in wire 4*a* were connected to each other by laser welding. Thereafter, an insulating layer 5*a* made of alumina was formed with a thickness of 1 μm by performing dipping on the outer circumferential surface of the cylindrical electrode 5 made of iron. A trial lamp H was formed in the same manner as the trial lamp E except for the above configuration.

The trial lamp H was used to conduct a lighting experiment in the same manner as (Experimental Example 1). The obtained experiment results were shown in FIG. 5.

In the trial lamp H, the internal lead-in wire 4*a* and the outer circumferential surface of the cylindrical electrode 5 were attached via insulating materials 5*a* and 4*b,* or the outer circumferential surface was insulated by oxidation and the like. Thus, negative glow discharge concentrated only on the inner surface of the cylindrical electrode 5 but did not spread to the outer circumferential surface of the cylindrical electrode 5 and the internal lead-in wire 4*a,* and blackening due to sputtering on the inner wall of the bulb concentrated only on the end of the electrode. Consequently, consumption of mercury due to excessive sputtering on the outer surface of the cylindrical electrode 5 and the internal lead-in wire 4*a* was reduced to 150 to 200 μg, thereby improving the effect of increasing the lifetime of the cold-cathode discharge lamp.

Additionally, the above described embodiments and experimental examples discussed an example in which the bottomed glass tube 2 formed into a cylinder was used as the cylindrical electrode 5. The present invention is not limited to the above configuration. The bottom may be eliminated, and coatings may be formed to provide a multilayer structure on the outside of the cylindrical electrode 5.

Further, the size, design, material, shape, and rating of the cold-cathode discharge lamp are not limited to the above explanation.

As described above, according to the cold-cathode discharge lamp of the present invention, a lead-in wire connected to an external power supply and provided at an end of the lighting tube having a phosphor applied onto an inner surface, an end of the lead-in wire is connected to a cylindrical electrode, and the phosphor is excited by ultraviolet radiation that is generated in the lighting tube by discharge to provide visible radiation. The lead-in wire in the lighting tube is made of the same material as a material that forms the cylindrical electrode, so that it is possible to suppress concentration of negative glow discharge shifted to the internal lead-in wire. The electrode is covered with even negative glow discharge, so that consumption of mercury due to excessive sputtering on the internal lead-in wire can be suppressed, thereby achieving a longer lifetime of the cold-cathode discharge lamp.

Also, negative glow discharge is caused to develop mainly on the inner surface of the cylindrical electrode in the following configuration as well: at least a part of the surface of the lead-in wire in the lighting tube is made of a material having a larger work function value than that of a material that forms the inner surface of the cylindrical electrode, or at least a part of the surface of the lead-in wire in the lighting tube is covered with an insulating coating. Thus, consumption of mercury due to excessive sputtering can be suppressed on the outer surface of the cylindrical electrode and the internal lead-in wire, thereby achieving the same effect.

What is claimed is:

1. A cold-cathode discharge lamp device, comprising:

a lighting tube having a phosphor portion located on an inner surface thereof;

an external power supply;

a cylindrical electrode comprising a closed end having a non-discharge side substantially perpendicular to cylindrical walls of the electrode; and a lead-in wire connected to the external power supply and located at an end of the lighting tube, wherein:

an end of said lead-in wire is connected to the non-discharge side of the closed end of the cylindrical electrode, and said phosphor is excited by ultraviolet radiation to obtain visible light, said ultraviolet radiation being generated by discharge in said lighting tube, and at least a part of said lead-in wire in said lighting tube and said cylindrical electrode are made of a same material.

2. A cold-cathode discharge lamp device, comprising a lighting tube having a phosphor portion located on an inner surface thereof;

an external power supply;

a cylindrical electrode; and a lead-in wire connected to the external power supply and located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and an outer surface of said lead-in wire in said lighting tube is covered with a material same as a material forming said cylindrical electrode.

3. A cold-cathode discharge lamp device, comprising a lighting tube having a phosphor portion located on an inner surface thereof;

an external power supply;

a cylindrical electrode; and a lead-in wire connected to the external power supply and located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and at least a part of a surface of said lead-in wire in said lighting tube comprises a material having a larger work function value than that of a material comprising an inner surface of said cylindrical electrode.

4. A cold-cathode discharge lamp device, comprising a lighting tube having a phosphor portion located on an inner surface thereof;

an external power supply;

a cylindrical electrode; and a lead-in wire connected to the external power supply and located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and at least a part of a surface of said lead-in wire in said lighting tube is covered with an insulating coating and at least a part of a surface of the cylindrical electrode is covered with an insulating coating.

5. A cold-cathode discharge lamp, comprising:

a lighting tube having a phosphor portion located on an inner surface thereof;

a cylindrical electrode comprising a closed end having a non-discharge side substantially perpendicular to cylindrical walls of the electrode; and a lead-in wire located at an end of the lighting tube, wherein:

an end of said lead-in wire is connected to the non-discharge side of the closed end of the cylindrical electrode, and said phosphor is excited by ultraviolet radiation to obtain visible light, said ultraviolet radiation being generated by discharge in said lighting tube, and at least a part of said lead-in wire in said lighting tube and said cylindrical electrode are made of a same material.

6. A cold-cathode discharge lamp, comprising a lighting tube having a phosphor portion located on an inner surface thereof;

a cylindrical electrode; and a lead-in wire located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and an outer surface of said lead-in wire in said lighting tube is covered with a material same as a material forming said cylindrical electrode.

7. A cold-cathode discharge lamp, comprising a lighting tube having a phosphor portion located on an inner surface thereof;

a cylindrical electrode; and a lead-in wire located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and at least a part of a surface of said lead-in wire in said lighting tube comprises a material having a larger work function value than that of a material comprising an inner surface of said cylindrical electrode.

8. A cold-cathode discharge lamp, comprising a lighting tube having a phosphor portion located on an inner surface thereof;

a cylindrical electrode; and a lead-in wire located at an end of the lighting tube, wherein:

an end of said lead-in wire is connected to the cylindrical electrode, said phosphor is excited by ultraviolet radiation to obtain visible light, said ultraviolet radiation being generated by discharge in said lighting tube, and at least a part of a surface of said lead-in wire in said lighting tube is covered with an insulating coating and at least a part of a surface of the cylindrical electrode is covered with an insulating coating.

* * * * *